US006161719A

United States Patent [19]

Madison

[11] Patent Number: 6,161,719

[45] Date of Patent: Dec. 19, 2000

[54] LIQUID STORAGE TANK APPARATUS AND METHOD OF FORMING SAME

[76] Inventor: Charles D. Madison, 10070 CR 461 S., Laneville, Tex. 75667

[21] Appl. No.: 09/460,497

[22] Filed: Dec. 14, 1999

Related U.S. Application Data

[62] Division of application No. 09/383,515, Aug. 23, 1999.

[51] Int. Cl.[7] ..... B65D 90/02

[52] U.S. Cl. ..... 220/567; 220/4.12; 220/DIG. 6; 220/563; 220/564

[58] Field of Search ..... 220/560.03, 1.5, 220/562, 563, 564, 565, 567, 4.12, DIG. 6

[56] References Cited

U.S. PATENT DOCUMENTS

| | | | |
|---|---|---|---|
| 2,163,387 | 6/1939 | Thwaits | 220/DIG. 24 |
| 3,050,210 | 8/1962 | Shang | 220/567 |
| 3,073,018 | 1/1963 | Gauthron | 220/567 |
| 3,363,795 | 1/1968 | Stuart, III | 220/567 |
| 4,234,036 | 11/1980 | Bachner | 164/420 |
| 4,479,637 | 10/1984 | Sangster et al. | 266/281 |
| 4,483,655 | 11/1984 | Snow et al. | 414/786 |
| 5,938,065 | 8/1999 | De Vivo et al. | 220/560 |

*Primary Examiner*—Joseph M. Moy
*Attorney, Agent, or Firm*—Harrison & Egbert

[57] ABSTRACT

A method of fabricating a tank including placing the tan lid on a support surface such that a surface of the lid faces downwardly, affixing first and second sides and first and second ends along and adjacent to a perimeter of the lid on an opposite surface of the lid, affixing a floor onto an edge of the first and second sides and the first and second ends opposite the lid, inverting the lid and the sides and the ends and the floor such that a surface of the floor faces downwardly, and affixing a cover over a hole formed in the floor. The hole in the floor is formed of a size suitable for allowing a human body to extend therethrough. All interior seams between the lid, the sides and the ends are welded internally. Similarly, all interior seams between the floor, the sides and the ends are welded internally. The cover has a surface which is welded solely externally to the floor.

4 Claims, 7 Drawing Sheets

LIQUID STORAGE TANK APPARATUS AND METHOD OF FORMING SAME

RELATED APPLICATIONS

The present application is a divisional application of U.S. patent application Ser. No. 09/383,515, filed on Aug. 23, 1999, and entitled "LIQUID STORAGE TANK APPARATUS AND METHOD OF FORMING SAME", presently pending.

TECHNICAL FIELD

The present invention relates to liquid storage tanks. More particularly, the present invention relates to methods for forming such liquid storage tanks. Additionally, the present invention relates to methods and apparatus for strengthening the junction between the sides, the ends, the floor and the lid of such liquid storage tanks.

BACKGROUND ART

Liquid storage tanks, such as those used on fire engines, have high strength requirements due to the weight of the liquid stored in the tanks. Liquid storage tanks for fire engines, for example, can hold a 1000 gallons or more of water and must obviously do so with high reliability.

Such liquid storage tanks have been developed with side, bottom and top pieces welded together to form the tank. These pieces are hand welded together by a traditional weld. The sides and the bottom are welded together by a hot tip hand welder guided along the side-bottom seam while the operator hand pushes a round welding rod into the hand welder. The welder melts the welding rods and applies them to the interior junctions between the sides and the bottom. The welds hold the sides, bottom and top pieces together under the force of water weight. Improvements in strength are desirable in order to increase tank capacities and reduce material costs.

A traditional technique for forming such liquid storage tanks is shown in U.S. Pat. No. 5,820,718, issued on Oct. 13, 1998 to T. S. Dean. As shown in FIG. 1 of this patent, the floor of the tank is placed on a support surface and the sides and ends are welded internally to the floor. A lid is then placed onto the opposite ends of the sides and ends and is welded to the sides and the ends by placing the lid a small distance below an upper edge of the sides and ends. In this manner, a single external weld is applied between the lid and the sides and ends. In this traditional technique of forming liquid storage tanks, it is only possible to apply a single external weld between the lid and the sides and the ends. As such, the strength of an interior weld is not made available. During emergency braking or rapid acceleration of the fire truck (or other apparatus), extra force and water pressure is applied to the tank's end walls and lid. This can cause the seams to split and possibly rupture. The tank lid is only welded on the outside edge and then welded to junction plates or pegs. Furthermore, because of the structure of such liquid storage tanks, it is impossible to weld the lid internally to such sides and ends. Additionally, all internal support gussets and baffles cannot be attached directly onto the lid. Since the lid is recessed, the lid will allow water to accumulate and possibly damage any equipment stored on the top of the tank.

It is an object of the present invention to provide a liquid storage tank in which all seams between the lid, the floor, the sides and the ends are welded internally.

It is another object of the present invention to provide a liquid storage tank in which the lid is not mounted flush to or above the sides so that water cannot accumulate thereon.

It is another object of the present invention to provide suitable gussets which connect the lid, the side walls and the floor together.

It is a further object of the present invention to provide a liquid storage tank in which baffles control water surge in the event of emergency braking or rapid acceleration.

It is still another object of the present invention to provide a liquid storage tank which has an access panel that can be modified for easy removal so as to facilitate repair of the baffles.

It is still another object of the present invention to provide a liquid storage tank which is stronger and more durable than existing designs.

It is still another object of the present invention to provide a liquid storage tank which is easy to manufacture and relatively inexpensive.

These and other objects and advantages of the present invention will become apparent from a reading of the attached specification and appended claims.

SUMMARY OF THE INVENTION

The present invention is a method of fabricating a tank comprising the steps of: (1) forming a tank lid, a first side, a second side, a first end, a second end, and a floor; (2) placing the lid on a support surface such that a surface of the lid faces downwardly; (3) affixing the sides and the ends along and adjacent to a perimeter of the lid on an opposite surface of the lid; (4) affixing the floor onto an edge of the first and second sides and the first and second ends opposite the lid; (5) inverting the tank lid, the sides, the ends and the floor such that a surface of the floor faces downwardly; and (6) affixing a cover over the hole in the floor.

In the present invention, the step of forming includes forming several slots in the tank lid adjacent to the perimeter, and forming a tongue along an edge of each of the sides and the ends. The respective tongues of the sides and the ends are inserted into the slots of the tank lid. In the present invention, the step of affixing includes welding interior seams between the ends and the sides and the tank lid. At least one gusset is affixed onto at least one of the sides of the tank such that the gusset extends transverse to the side.

In the method of the present invention, the step of inverting includes elevating the tank above the support surface such that the hole will face the support surface a distance above the support surface. A welding device can be extended through the hole so as to weld interior seams between the floor and the sides and the ends. Baffles are connected to the gusset in an area between the sides and between the lid and the floor. A welding device is extended through the hole so as to weld the baffle to the gussets.

In the present invention, the step of affixing a cover includes forming a cover having a surface of greater area than an area of the hole, inserting the cover through the hole, laying the cover flat across the hole, and welding an exterior seam between the cover and the floor. The cover can be formed so as to have an insert portion having a size generally matching the hole. The edge of the insert portion is welded to an exterior surface of the floor.

The liquid storage tank of the present invention comprises a floor having a hole formed therein and a size suitable for allowing a human body to extend therethrough, a first side affixed to a first edge of the floor, a second side affixed to an opposite edge of the floor, a first end affixed between the first and second sides and to a third edge of the floor, a second end affixed between the first and second sides and to a fourth edge of the floor, and a lid affixed to an edge of the first and second sides and the first and second ends opposite the floor. A cover is affixed so as to have a surface overlying entirely over the hole in the floor. The cover is positioned between the floor and the lid. The floor, the first and second sides, the first and second ends and the lid are all formed of a polymeric material. The lid is formed so as to extend at least flush or entirely above the edges of the sides and the ends.

DETAILED DESCRIPTION OF THE INVENTION

The present invention is an improved method for fabricating a liquid storage tank. The liquid storage tank is of a type for storing liquid such as that shown in U.S. Pat. No. 5,820,718, with certain modifications. The method of the present invention offers an improved technique for the assembly of such liquid storage tanks wherein the various seams and components of the liquid storage tank are more securely joined together.

Figure 1:
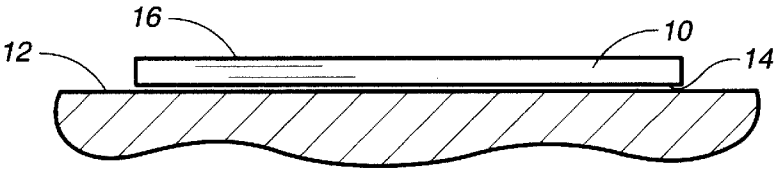
FIG. 1 is a side elevational view showing the first step in the method of the present invention.

Referring to FIG. 1, it can be seen that the tank lid 10 is placed upon a floor or other support surface 12. The lid 10 has a surface 14 which faces the support surface 12. The opposite side 16 of lid 10 faces away from the support surface 12.

Figure 2:
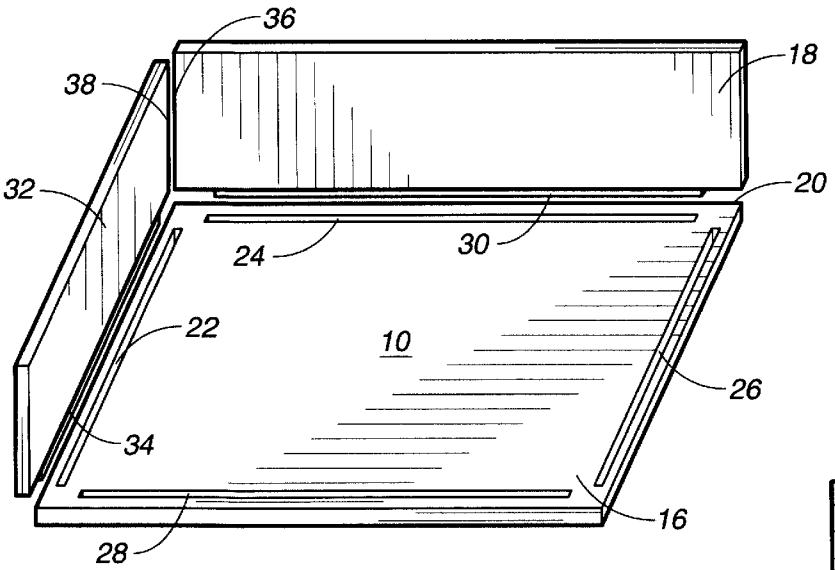
FIG. 2 is a perspective view showing the initial stages in the fabricating of the tank of the present invention.

FIG. 2 shows the initial stages in the assembly of the present invention. In FIG. 2, it can be seen that a first side 16 is arranged for attachment onto an edge 20 of the lid 10. A plurality of slots 22, 24, 26 and 28 extend generally around the perimeter of the lid 10. The side 18 is a planar member having a tongue 30 extending downwardly therefrom. The tongue 30 is suitable for receipt into slot 24 adjacent one side of the lid 10. Similarly, an end 32 has a tongue 34 formed thereon. The tongue 34 is suitable for engagement into the slot 22. Corresponding tongue-and-grooves can be found along the adjacent edges 36 of the side 18 and edge 38 of end 32. As such, it can be seen that the arrangement of the present invention provides for interlocking sides, ends and lid. Within the concept of the present invention, a second side is suitable for insertion into slot 28 on the lid 10. Another end, similar to end 32 is suitable for receipt into slot 26 along an opposite edge of the lid 10. Each of these components can be assembled together so as to provide the initial structure of the tank of the present invention.

Figure 3:
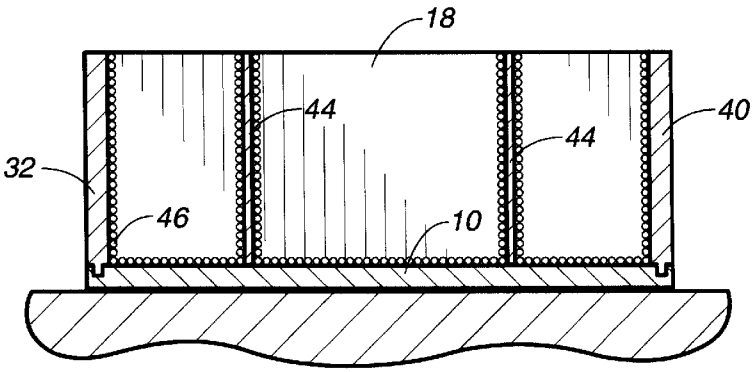
FIG. 3 is a cross-sectional view showing the initial stages of the assembly of the tank of the present invention.

FIG. 3 shows the initial assembly of the tank of the present invention. Initially, it can be seen that the first end 32 is affixed onto one end of the lid 10. A second end 40 is affixed to an opposite end of the lid 10. As can be seen, the first end 32 is arranged in generally parallel relationship to the second end 40. The ends 32 and 40 extend upwardly generally transverse to the lid 10. A first gusset 42 and a second gusset 44 are affixed so as to extend outwardly transverse to the side 18. In this arrangement, the person assembling the tank of the present invention can simply extend the welding device downwardly so as to extend a welding bead 46 along the seams between the end 32 and the side 18, between the end 40 and the side 18, between the side 18 and the lid 10, and along the sides of the respective gussets 42 and 44. Although the second side is not shown in FIG. 3, similar welding can be carried out so as to affix the second side directly along the opposite edge of the lid 10 from the first side 18 and to secure the second side to the respective edges of the ends 32 and 40.

Figure 4:
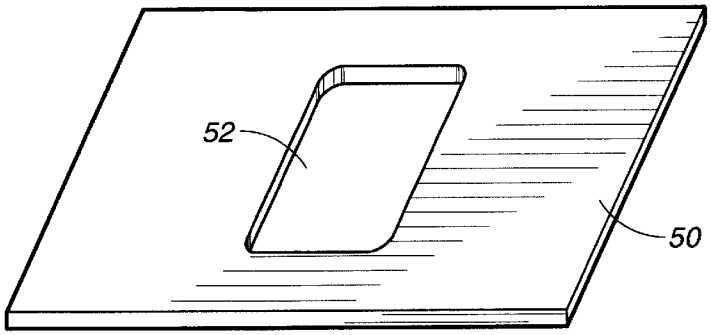
FIG. 4 is an upper perspective view showing an isolated view of the floor of the present invention.

FIG. 4 illustrates the formation of the floor 50. A hole 52 is formed generally in the center of the floor 50. Hole 52 will have a configuration and size suitable for allowing a human body to extend therethrough. Hole 52 is particularly configured so as to have the workmen reach upwardly therethrough so as to have proper reach for the welding of all of the interior seams of the tank assembly. So as to allow a cover to be inserted through the hole 52, the hole 52 will have a rectangular configuration. Alternatively, the hole 52 can be of oval shape or other elongated form.

Figure 5:
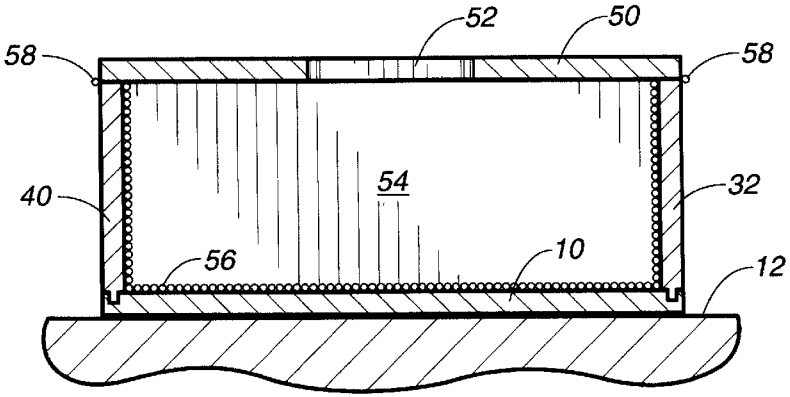
FIG. 5 is a cross-sectional view showing the installation of the floor initially onto the remainder of the tank.

In FIG. 5, it can be seen that the lid 10 rests upon the support surface 12. FIG. 5 shows the opposite side in a cross-sectional view of the tank assembly. In FIG. 5, end 40 extends upwardly from the lid 10. Similarly, the end 32 will also extend upwardly from an opposite edge of the lid 10. The opposite side 54 is affixed to the lid 10 and is also affixed to the edges of the ends 32 and 40 in the manner described hereinbefore in FIG. 3. Suitable welding beads will extend along all of the internal seams between the sides 54, the ends 32 and 40, and the lid 10. In FIG. 5, welding bead 56 is illustrated so as to indicate how the second side 54 is joined, respectively, to the ends 32 and 40 and to the lid 10.

In FIG. 5, after the internal welding has occurred, the floor 50 is placed upon the edges of the ends 32 and 40 opposite the lid 10. A tack weld 58 is applied on the exterior seam between the floor 50 and the ends 32 and 40. As such, the floor 50 will be secured in a proper position. Hole 52 is illustrated as opening into the interior of the tank in the area between the lid 10, the ends 32 and 40, and the sides 18 and 54.

Figure 6:
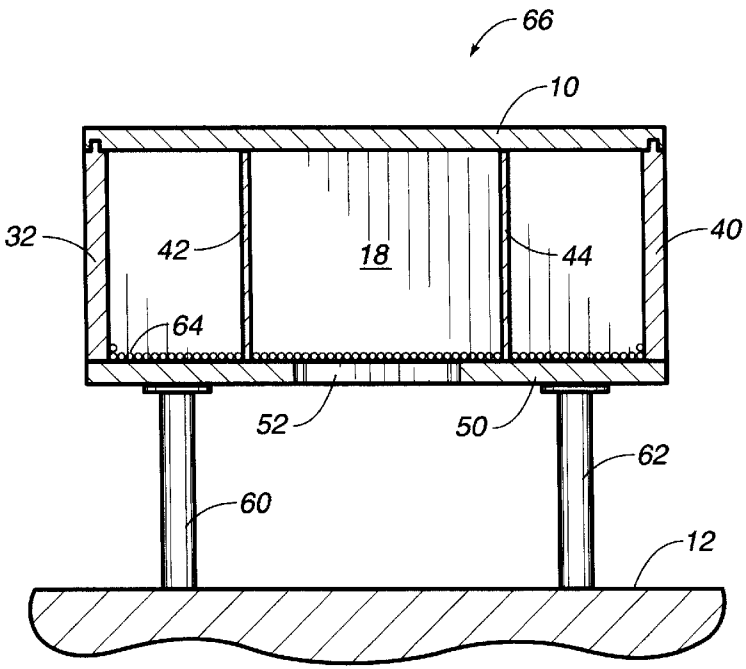
FIG. 6 is a cross-sectional view showing the inverting of the tank from FIG. 5.

Importantly, so as to allow for the welding of the internal seams between the floor 50 and the ends 32 and 40, and the sides 18 and 54, the tank is inverted in the manner shown in FIG. 6.

In FIG. 6, the floor 50 is inverted so as to rest upon stands 60 and 62 well above the support surface 12. Stands 60 and 62 should be configured so as to elevate the floor 50 a suitable distance so that a workman can sit on a chair or stand and so that the workman can reach through the hole 52 for the purpose of welding the internal seams. Because of the configuration of the floor 50 with the hole 52 formed therein, the workman can use the welding device and apply a weld bead 64 in the area between the floor 50 and the sides 18 and 54 and between the floor 50 and the ends 32 and 40. As such, all of the internal seams of the liquid storage tank of the present invention can be appropriately welded. Unlike the prior art, there are no unwelded seams on the interior of the tank 66, as illustrated in FIG. 6. Further welding can also occur as to the internal structure such as to the gussets 42 and 44 and any associated baffles connected thereto. Additionally, suitable welds can be carried out so as to secure the gussets 42 and 44 to the surface of the floor 50.

Figure 7:
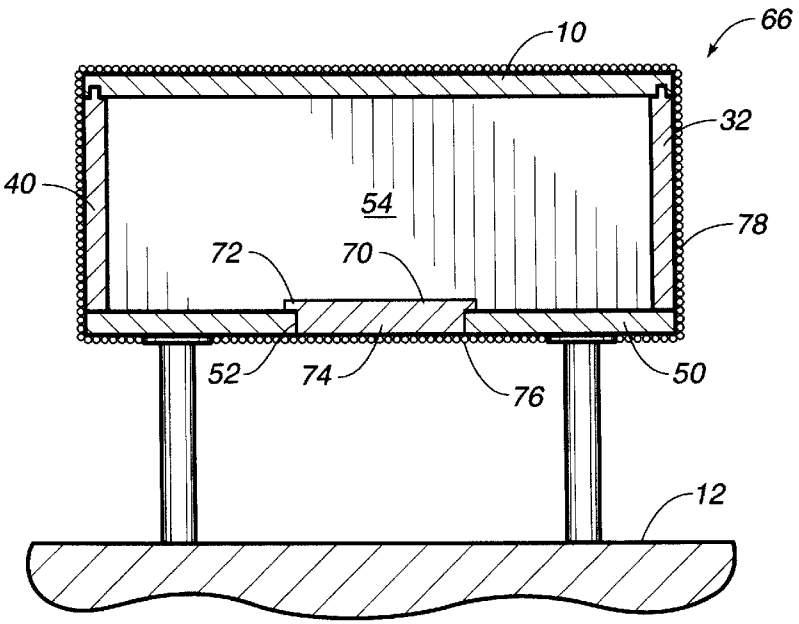
FIG. 7 is a cross-sectional view showing the final stages in the fabricating of the tank in accordance with the present invention.

FIG. 7 illustrates the final steps associated with preparing the liquid storage tank 66 of the present invention. Internal plumbing and apple structures have been omitted from the illustration of FIG. 7 for the purpose of clarity. After the internal welding has occurred, in the manner shown in FIG. 6, a cover 70 is applied over the hole 52 in the floor 50. Cover 70 has a surface 72 having a greater area than the area of the hole 52. An insert portion 74 extends downwardly from surface 72. Insert portion 74 has a size generally matching the area of the hole 52. As such, the cover 70 effectively "covers and plugs" the hole 52. The insert portion 74 of the cover 70 is then welded at external welds 76 to the exterior surface of the floor 50. External welds 78 can then be applied to all of the external seams between the lid 10, the ends 32 and 40, the sides 18 and 54, and the floor 50. As can be seen from the entirety of the drawings, the present invention provides a liquid storage tank in which all external and internal seams between the walls of the tank are both internally and externally welded. It can be seen that the only area in which there are no internal welds is associated with the cover 70. With cover 70, only an external weld at the cover edge 76 serves to secure the cover 70 to the floor 50.

Figure 8:
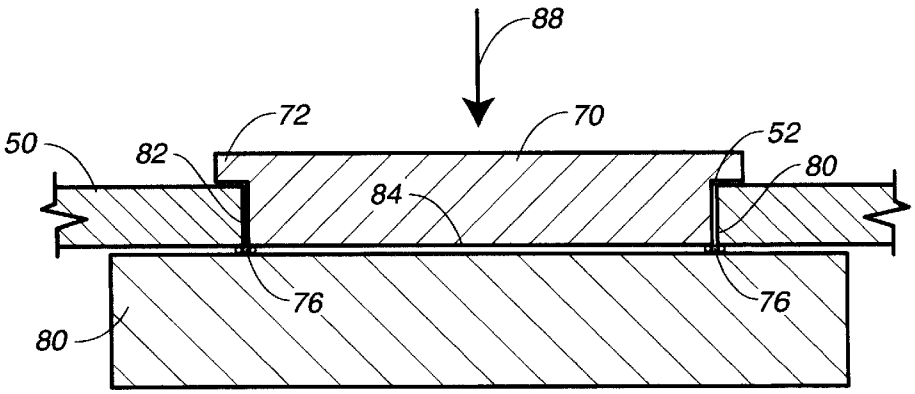
FIG. 8 is an isolated cross-sectional view showing the installation of the access cover onto the floor of the tank of the present invention.

FIG. 8 illustrates that because of the particular configuration of the cover 70, it is not important that there is only a single external weld. In FIG. 8, it can be seen that the floor 50 rests upon the frame 80 of a vehicle. As can be seen, the cover 70 has surface 72 which will overlie edges 82 of the hole 52 in the floor 50. The insert portion 74 has a size which generally matches the size of the hole 52. The exterior surface 84 of the insert portion 74 of cover 70 is affixed to the floor 50 by external welds 76.

It is important to note that only the external weld 76 is required for the proper installation of the cover 70 over the hole 52. The structure of the tank remains secure by virtue of the fact that the water pressure on the interior of the tank exerts a force downwardly as indicated by arrow 88. As such, the force of the water itself serves to hold the cover 70 in its desired position onto the floor 50. The force of the water eliminates the need for internal welds between the cover 70 and the interior surface of the floor 50. In the present invention, the respective ends 32 and 40 and the sides 18 and 54 are secured in their desired position by both internal and external welds. As such, these surfaces strongly resist the forces imparted by the water pressure during rapid acceleration or deceleration. The force imparted upon the cover 70 will be relatively unchanged during periods of rapid acceleration or deceleration. As such, internal welding is not necessary.

Figure 9:
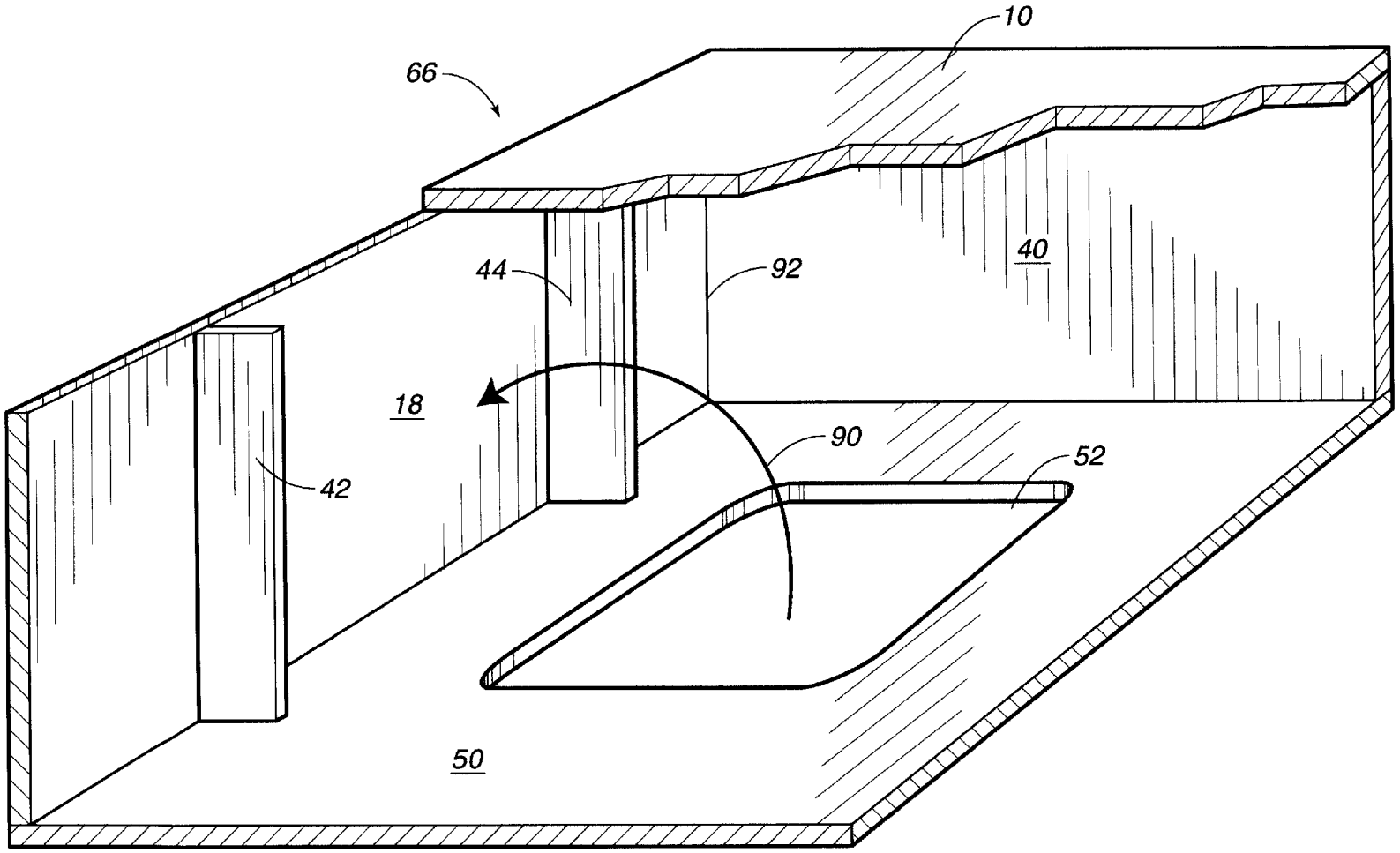
FIG. 9 is a broken away perspective view showing the interior of the tank of the present invention.

FIG. 9 shows an internal view of the tank 66. As can be seen, the gussets 42 and 44 are affixed onto the interior surface of side 18. The gussets 42 and 44 can also be secured, by welding to the floor 50. Hole 52 is formed generally in the center of the interior of the floor 50. The arrow 90 shows how the workman can extend the welding device into the interior of the tank 66 for the purpose of welding the internal seams. Lid 10 is shown, in broken fashion, as extending over the top of the tank 66. End wall 40 extends between the floor 50 and the lid 10. End wall 40 is secured to the side 18 along seam 92.

Figure 10:
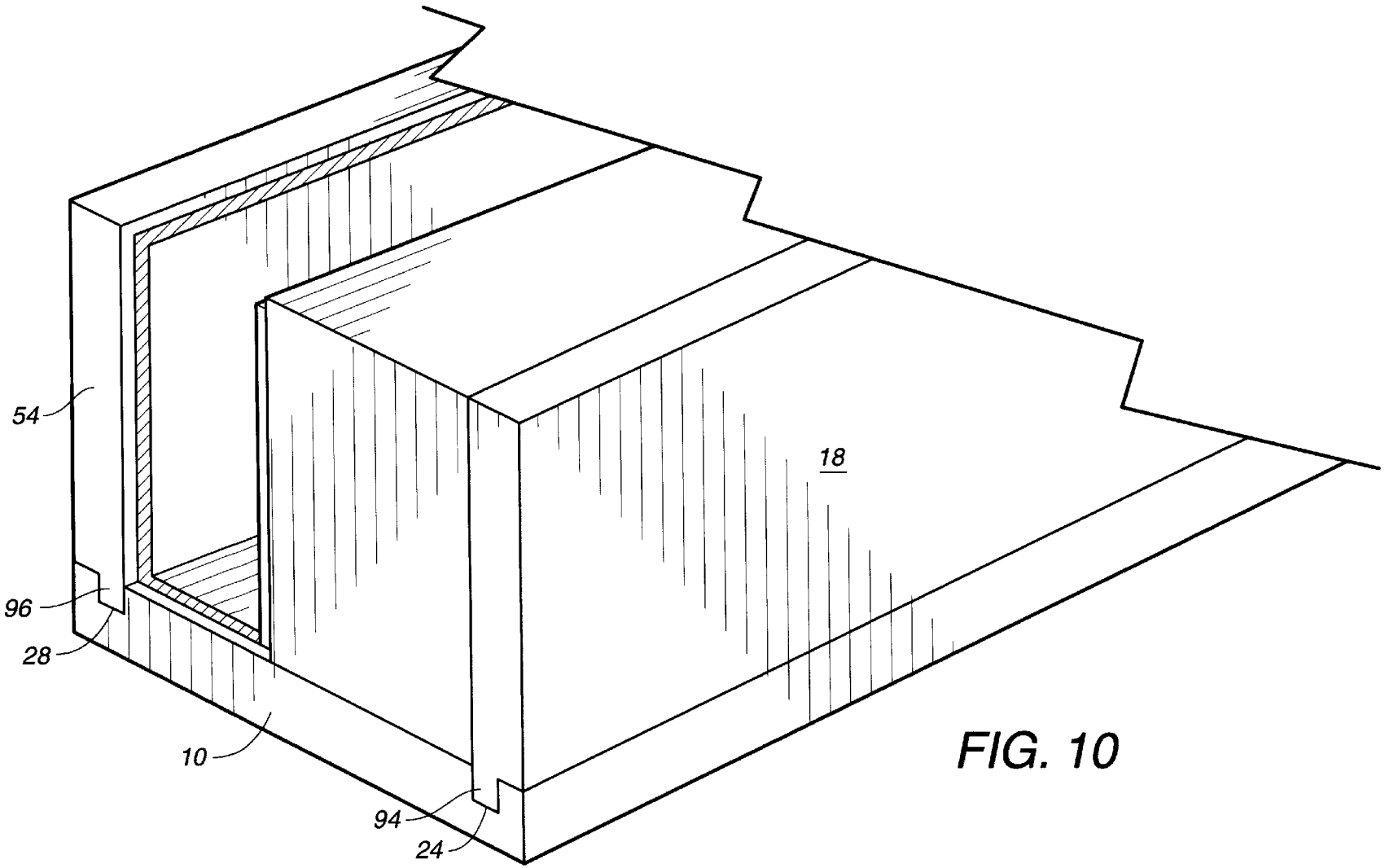
FIG. 10 is a perspective, partially broken away, view showing the interlocking nature of the components of the present invention.

FIG. 10 shows how the sides 18 and 54 have interlocking tongues 94 and 96, respectively, to be received within the slots 24 and 28 of the lid 10. The interlocking grooves assures a solid connection between each of the components of the tank of the present invention.

Figure 11:
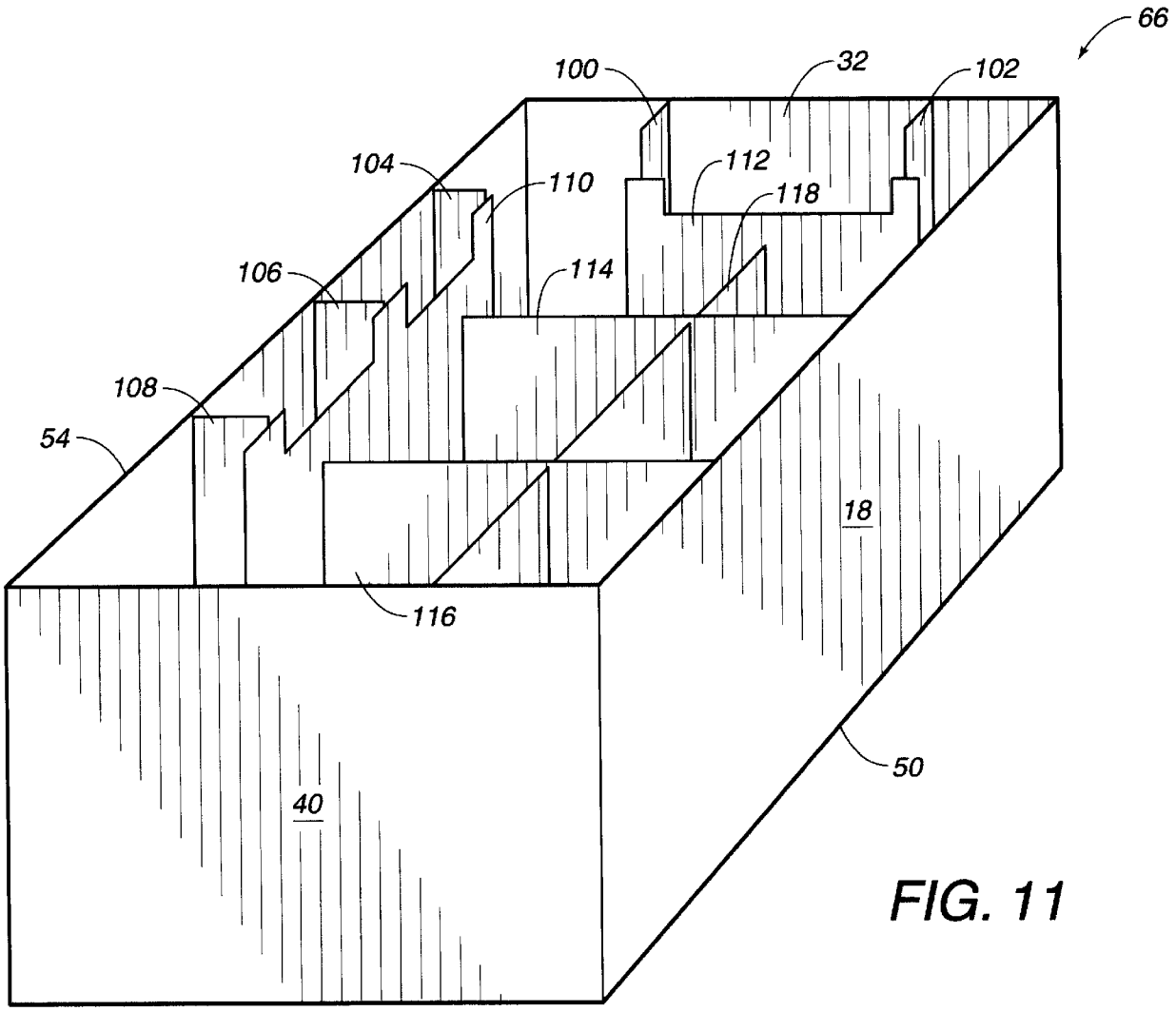
FIG. 11 is a perspective interior view showing the assembly of gussets and baffle on the interior of the tank.

FIG. 11 shows the internal structure of baffles and gussets within the tank 66. In FIG. 11, it can be seen that sides 18 and 54 extend upwardly and extend longitudinally across the tank 66. Ends 32 and 40 extend between the sides 18 and 54 above the floor 50. In FIG. 11, it can be seen that gussets 100 and 102 are affixed to the end wall 32 and extend outwardly transversely therefrom. Gussets 104, 106 and 108 extend outwardly transverse to the side wall 54. Similar arrangements of gussets are found on the other end wall 40 and on the other side wall 18. A baffle 110 is secured to the gussets 104, 106 and 108 and extends generally parallel to the side 54. A baffle 112 is secured to the gussets 100 and 102 and extends transverse toward the sides 18 and 54. Baffles 114 and 116 also extend transverse towards the sides 18 and 54. Baffles 114 and 116 have their ends secured to the baffle 110. The opposite ends of the baffles 114 and 116 are secured, in a like manner, to a longitudinal baffle adjacent to the wall 18. Another longitudinal baffle 118 has one end engaged with transverse baffle 112 and an opposite end engaged with a similar baffle extending from the other end 40. Longitudinal baffle 118 is also connected to baffles 114 and 116. This arrangement of the various baffles on the interior of tank 66 serve to decelerate the force of water during acceleration or deceleration of the vehicle carrying the liquid storage tank 66. Similarly, baffles 110 and 118 can serve to reduce the force of side-to-side movement of the water within the liquid storage tank 66. The use of the hole 52 in the floor 50 allows the workman to effectively weld the various baffles together on the interior of tank 66. Such welding would be virtually impossible with the prior art configuration of liquid storage tanks.

Figure 12:
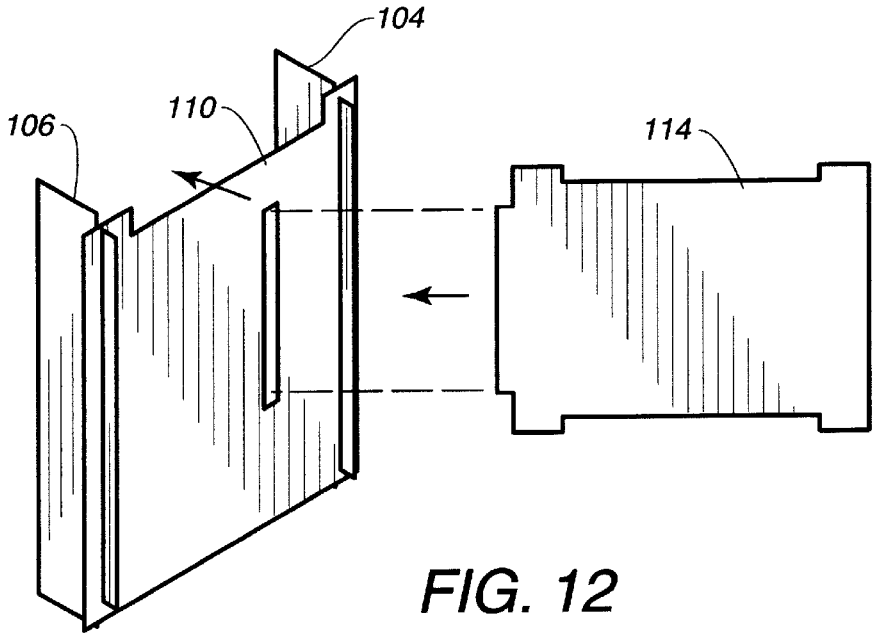
FIG. 12 is an exploded view showing the assembly of a transverse baffle onto a longitudinal baffle.

FIG. 12 illustrates the manner in which the baffle 110 can be secured to gussets 104 and 106. Additionally, FIG. 12 shows how baffle 114 can be received within a slot 122 formed in baffle 110. As such, each of the components of the present invention can be arranged in an interlocking fashion for additional security. The connection between the respective baffles can be welded together for security.

Figure 13:
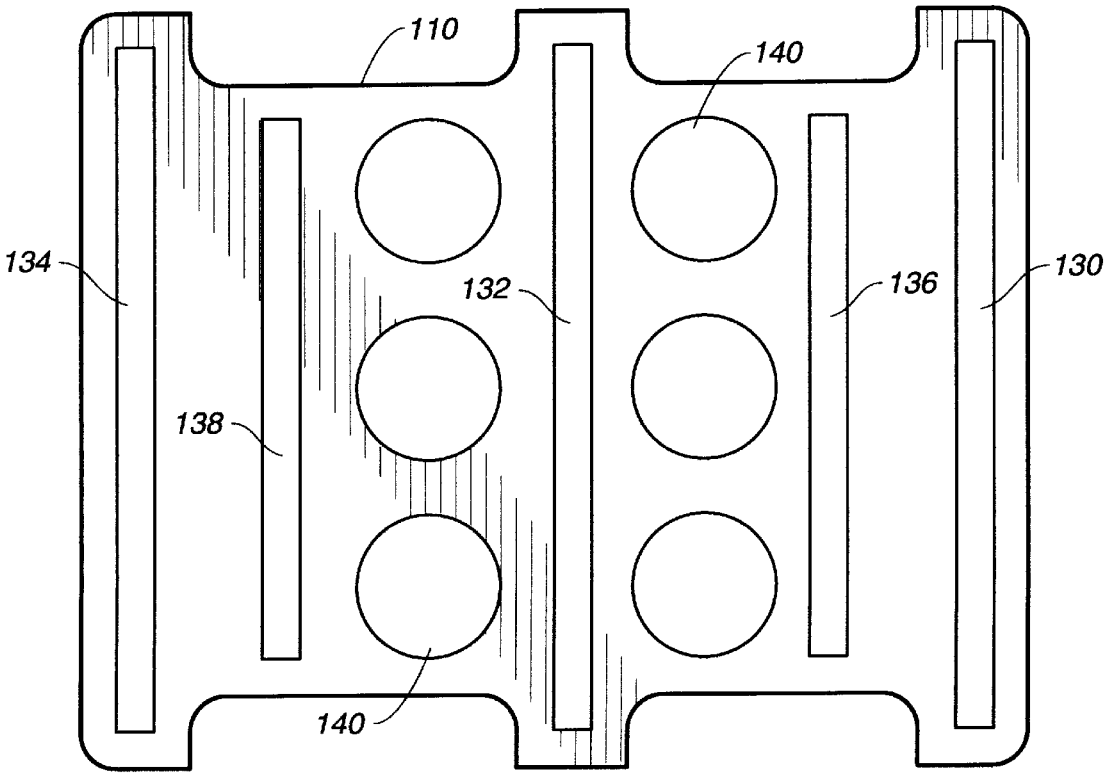
FIG. 13 is an isolated end view showing the configuration of baffles as used in the present invention.

FIG. 13 is a detailed illustration of baffle 110. As can be seen, slots 130, 132 and 134 are provided in the baffle 110 so as to engage with the gussets 104, 106 and 108, respectively. Slots 136 and 138 are formed on the baffle 110 so as to receive the ends of transverse baffles 114 and 116. The various holes 140 allow water to be transmitted thereto while reducing the acceleration of the liquid flow therethrough. As such, baffle 110 effectively prevents water flow from damaging the sides or ends of the liquid storage tank.

The present invention is a method of fabricating a water tank that allows all of the seams to be welded internally and externally. The present invention completely joins the lid to the end walls, the side walls and fluid. The process, including the interlocking of all walls, floor and lid, results in a virtually indestructible tank with a flush lid. While accomplishing this purpose, it remain relatively cost effective.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A liquid storage tank comprising:

a floor having a hole formed therein, said hole having a size suitable for allowing a human body to extend therethrough;

a first side affixed to a first edge of said floor;

a second side affixed to a second edge of said floor;

a first end affixed between said first and second sides and to a third edge of said floor;

a second end affixed between said first and second sides and to a fourth edge of said floor;

a lid affixed to an edge of said first and second sides and said first and second ends opposite said floor; and a cover affixed so as to have a surface overlying entirely over said hole of said floor, said cover positioned between said floor and said lid, said floor and said first and second sides and said first and second ends and said lid being formed of polymeric material, each seam between said lid and said first and second ends and said first and second sides is welded internally and each seam between said floor and said first and second ends and said first and second sides is welded internally, said cover having a seam with said floor welded solely externally.

2. The tank of claim 1, said lid being at least flush or extending above said edge of said first and second sides and said first and second ends.

3. The tank of claim 1, further comprising:

at least one gusset welded to one of said first and second sides;

a plurality of baffles interconnected to said gusset and extending in transverse relationship to said first and second side; and at least one baffle connected to said plurality of baffles and extending transversely to said first and second ends.

4. The tank of claim 1, said lid having slots formed adjacent to a perimeter thereof, each of said first and second sides and said first and second ends having a tongue engaged with a respective in said lid.

* * * * *

UNITED STATES PATENT AND TRADEMARK OFFICE

CERTIFICATE OF CORRECTION

PATENT NO. : 6,161,719

DATED : December 19, 2000

INVENTOR(S) : Madison, Charles D.

It is certified that error appears in the above-identified patent and that said Letters Patent is hereby corrected as shown below:

Title apge, item [75],
"Inventor:", lines 1-2 of the Inventor section,
delete "10070 CR 461 S., Laneville, Tex. 75667" and
substitute --22867 Southwest 119th St., Dunnellon,
Florida 3441--.

Signed and Sealed this

First Day of May, 2001

*Attest:*

Nicholas P. Godici

NICHOLAS P. GODICI

*Attesting Officer*

*Acting Director of the United States Patent and Trademark Office*